US010208697B2

(12) United States Patent
Rosalik, Jr.

(10) Patent No.: US 10,208,697 B2
(45) Date of Patent: Feb. 19, 2019

(54) DETECTION OF IRREGULARITIES IN ENGINE CYLINDER FIRING

(71) Applicant: GM GLOBAL TECHNOLOGY OPERATIONS LLC, Detroit, MI (US)

(72) Inventor: Martin E. Rosalik, Jr., Oakland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 108 days.

(21) Appl. No.: 15/334,334

(22) Filed: Oct. 26, 2016

(65) Prior Publication Data

US 2018/0112617 A1 Apr. 26, 2018

(51) Int. Cl.

| | |
|---|---|
| ***F02D 41/28*** | (2006.01) |
| ***F02D 35/02*** | (2006.01) |
| ***F02D 41/14*** | (2006.01) |

(52) U.S. Cl.

CPC ..... *F02D 41/28* (2013.01); *F02D 35/02* (2013.01); *F02D 41/1498* (2013.01); *F02D 2041/288* (2013.01); *F02D 2200/101* (2013.01); *F02D 2250/14* (2013.01)

(58) Field of Classification Search

CPC .... F02D 41/22; F02D 41/28; F02D 2041/288; F02D 2041/286; F02D 2041/227

See application file for complete search history.

(56) References Cited

U.S. PATENT DOCUMENTS

| | | | | |
|---|---|---|---|---|
| 6,553,816 | B1 * | 4/2003 | Palanisamy | F02D 41/22 324/378 |
| 8,626,371 | B2 * | 1/2014 | Kumar | F02D 41/0097 318/139 |
| 9,109,517 | B2 * | 8/2015 | Banerjee | F01D 15/10 |
| 2008/0195350 | A1 * | 8/2008 | Miyano | G01P 3/44 702/147 |
| 2009/0033357 | A1 * | 2/2009 | Lindsey | G01R 31/346 324/765.01 |
| 2017/0166186 | A1 * | 6/2017 | Kim | B60W 20/15 |
| 2017/0166187 | A1 * | 6/2017 | Eo | B60K 6/485 |
| 2017/0166188 | A1 * | 6/2017 | Kim | B60W 20/17 |
| 2017/0166189 | A1 * | 6/2017 | Eo | B60W 20/17 |
| 2017/0166190 | A1 * | 6/2017 | Eo | B60W 20/17 |
| 2017/0254726 | A1 * | 9/2017 | Das | G01M 15/11 |

* cited by examiner

*Primary Examiner* — Erick Solis
*Assistant Examiner* — Anthony L Bacon
(74) *Attorney, Agent, or Firm* — Quinn IP Law

(57) ABSTRACT

A powertrain assembly includes an engine having at least one cylinder and at least one electric machine operatively connected to the engine. A motor speed sensor is operatively connected to and configured to obtain motor speed data of the electric machine. A controller is operatively connected to the motor speed sensor. The controller including a processor and tangible, non-transitory memory on which is recorded instructions for executing a method for detection of firing irregularities in the at least one cylinder. Execution of the instructions by the processor causes the controller to obtain the motor speed data at a predefined time interval from the motor speed sensor, until a predefined time window is reached. A fast Fourier transform of the motor speed data during the predefined time window is obtained. The controller is configured to control the engine based at least partially on the fast Fourier Transform.

13 Claims, 2 Drawing Sheets

DETECTION OF IRREGULARITIES IN ENGINE CYLINDER FIRING

INTRODUCTION

The present disclosure relates to detection of irregularities in engine cylinder firing in a powertrain assembly. Engine cylinder firing irregularities may be identified by monitoring crankshaft acceleration, via angular velocity data obtained from a crankshaft position sensor. However, this approach requires a substantial amount of time.

SUMMARY

A powertrain assembly includes an engine having at least one cylinder and at least one electric machine operatively connected to the engine. A motor speed sensor is operatively connected to and configured to obtain motor speed data of the electric machine. A controller is operatively connected to the motor speed sensor. The controller including a processor and tangible, non-transitory memory on which is recorded instructions for executing a method for detection of firing irregularities in the cylinder. Execution of the instructions by the processor causes the controller to obtain the motor speed data at a predefined time interval from the motor speed sensor, until a predefined time window is reached. A fast Fourier transform of the motor speed data during the predefined time window is obtained. The controller is configured to monitor and/or control the engine based at least partially on the fast Fourier Transform.

The controller may be programmed to obtain an engine firing frequency (EFF) from the fast Fourier transform, the engine firing frequency (EFF) being a relative maximum within a predefined range of a calculated engine firing frequency. The calculated engine firing frequency may be obtained as a product of an average engine speed during the predefined time window and a factor. The factor is the number of cylinders in the engine divided by two ($n_{cyl}/2$). The average engine speed may be determined from engine speed data obtained by an engine speed sensor.

The controller may be programmed to obtain a first amplitude ($A_{F1}$) at a first reference frequency (F1) from the fast Fourier transform. A second amplitude ($A_{F2}$) at a second reference frequency (F2) is obtained from the fast Fourier transform. A third amplitude ($A_{EFF}$) at the engine firing frequency (EFF) is obtained from the fast Fourier transform. The controller may be programmed to determine if at least one of the first amplitude ($A_{F1}$) and the second amplitude ratio ($A_{F2}$) is at or above the third amplitude ($A_{EFF}$) [$A_{F1}$ or $A_{F2} \geq A_{EFF}$].

The controller may be programmed to obtain a first ratio ($A_{F1}/A_{EFF}$) as a ratio of the first and third amplitudes, and determine if the first amplitude ratio ($A_n/A_{FF}$) is at or above a first threshold ($T_1$). If the first ratio ($A_n/A_{FF}$) is at or above the first threshold ($T_1$), the controller is programmed to shift to a first predefined operating mode ($O_1$) and/or display a second message on a user interface. The first reference frequency (F1) may be half the engine firing frequency (EFF) such that (EFF=2*F1).

The controller may be programmed to obtain a second ratio ($A_{F2}/A_{EFF}$) as a ratio of the second and third amplitudes. If the first ratio ($A_n/A_{FF}$) is below the first threshold ($T_1$), the controller is programmed to determine if the second ratio ($A_{F2}/A_{FF}$) is at or above a second threshold ($T_2$). The second reference frequency (F2) may be half the first reference frequency (F1) such that (F1=2*F2).

If the second ratio ($A_{F2}/A_{FF}$) is at or above the second threshold ($T_2$), the controller may be programmed to display a second message on a user interface. If the second ratio ($A_{F2}/A_{FF}$) is below the second threshold ($T_2$), the controller may be programmed to display a third message on the user interface. If the second ratio ($A_{F2}/A_{FF}$) is at or above the second threshold ($T_2$), the controller may be programmed to shift to a second predefined operating mode ($O_2$). If the second ratio ($A_{F2}/A_{FF}$) is below the second threshold ($T_2$), the controller may be programmed to shift to a third predefined operating mode ($O_3$). The assembly provides an early detection system capable of detecting issues prior to an actual irregular cylinder firing event.

The above features and advantages and other features and advantages of the present disclosure are readily apparent from the following detailed description of the best modes for carrying out the disclosure when taken in connection with the accompanying drawings.

DETAILED DESCRIPTION

Figure 1:
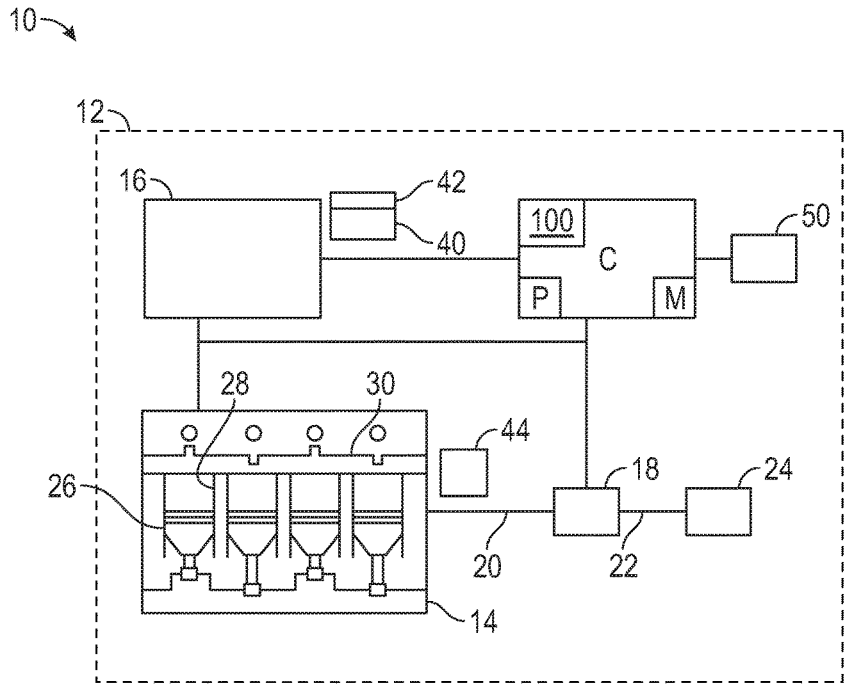
FIG. 1 is a schematic fragmentary view of a powertrain assembly having an engine, a motor speed sensor and a controller.

Referring to the drawings, wherein like reference numbers refer to like components, FIG. 1 schematically illustrates a powertrain assembly 10. The assembly 10 may be part of a device 12. The device 12 may be a mobile platform, such as, but not limited to, standard passenger car, sport utility vehicle, light truck, heavy duty vehicle, ATV, minivan, bus, transit vehicle, bicycle, robot, farm implement, sports-related equipment, boat, plane, train or other transportation device. The device 12 may take many different forms and include multiple and/or alternate components and facilities.

Referring to FIG. 1, the assembly 10 includes an engine 14 and at least one electric machine 16. The engine 14 and electric machine 16 each generate power which can be transmitted to a transmission 18. The engine 14 may be a suitable internal combustion engine capable of transforming hydrocarbon fuel to mechanical power to generate torque. The electric machine 16 may be a three-phase AC machine, such as a permanent magnet machine, an induction machine, or other type of motor/generator employed by those skilled in the art. Referring to FIG. 1, the engine 14 operates to transmit torque to the transmission 18 via an input shaft 20. An output shaft 22 operatively connects the transmission 18 to a driveline 24 for the device 12, to provide output power, e.g., to wheels (not shown) of the device 12.

Referring to FIG. 1, the engine 14 contains a plurality of cylinders, represented by the cylinder 26. Each cylinder 26 houses a respective piston, represented by piston 28. A camshaft 30 is located within the engine 14 for opening and closing respective valves associated with each cylinder 26. While the embodiment shows four cylinders, it should be appreciated that the engine 14 may include fewer or more cylinders. The engine 14 may be a two-stroke engine system, a spark-ignited engine, a diesel engine or other type of engine employed by those skilled in the art.

Figure 2:
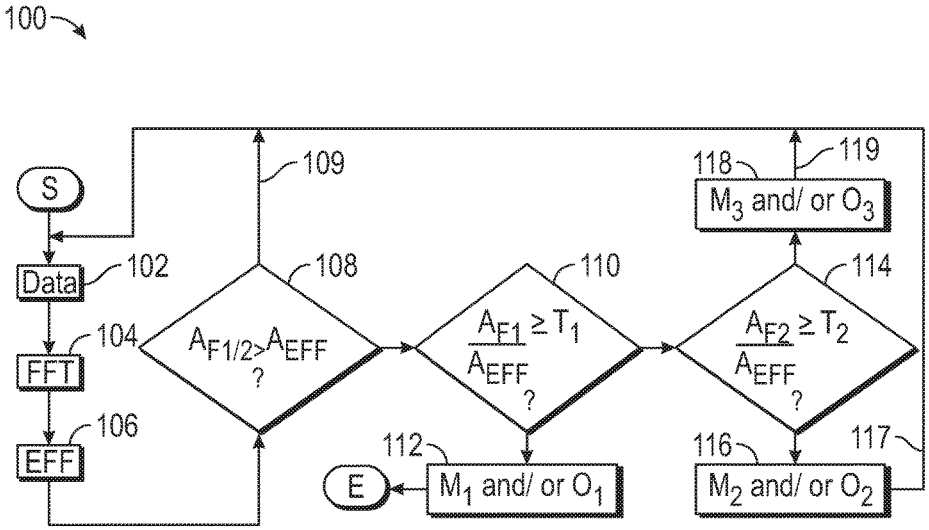
FIG. 2 is a flowchart for a method for controlling the assembly of FIG. 1.

Referring to FIG. 1, the assembly 10 includes a controller C having at least one processor P and at least one memory M (or non-transitory, tangible computer readable storage medium) on which are recorded instructions for executing method 100, shown in FIG. 2, for detection of firing irregularities in each of the cylinders 26. The memory M can store controller-executable instruction sets, and the processor P can execute the controller-executable instruction sets stored in the memory M. The controller C of FIG. 1 is configured, i.e., specifically programmed, to execute the blocks of the method 100 and may employ sensors such as motor speed sensor 40.

Referring to FIG. 1, the motor speed sensor 40 is operatively connected to and configured to obtain motor speed data of the electric machine 16. An engine speed sensor 44 is in communication (e.g., electronic communication) with the controller C and capable of measuring the speed of the engine 14. The motor speed sensor 40 is configured to feed rotary position data to the controller C. The motor speed sensor may include a memory buffer 42 to store the rotary position data. The electric machine 16 is operatively coupled to the engine 14 in such a way that imbalances in the engine 14 result in speed disturbances in the motor speed data of the electric machine 16. In one example, the motor speed sensor 40 is a brushless transmitter resolver. The motor speed sensor 40 may be a differential resolver or other type of sensor employed by those skilled in the art.

Referring now to FIG. 2, a flowchart of the method 100 stored on and executable by the controller C is shown. Method 100 need not be applied in the specific order recited herein. Furthermore, it is to be understood that some blocks may be eliminated. The start and end of the method 100 are indicated by "S" and "E", respectively. The controller C is programmed to receive snap-shots of motor speed data from the motor speed sensor 40, and perform a fast Fourier transform analysis upon it. Healthy periodic firing pulses of the engine 14 will show up in the fast Fourier transform at an expected frequency and power spectrum. Unhealthy firing pulses or system disturbances will show up as an unexpected power spectrum and frequency. Proper sampling rates and other parameters can provide a much earlier diagnosis of engine cylinder firing and powertrain resonance issues. The controller C (and execution of the method 100) improves the functioning of the device 12 by a fast and early detection of irregularities in cylinder firing in a complex engine system with minimal calibration required.

The method 100 may begin with block 102, where the controller C is programmed to obtain motor speed data at a predefined time interval from the motor speed sensor 40, until a predefined time window is reached. In one embodiment, the predefined time interval is 5 milliseconds and the predefined time window is 5 seconds. The motor speed data may be transferred to the controller C via an internal I/O processor, the CAN communication protocol, a tap-in method, or other methods employed by those skilled in the art.

Figure 3:
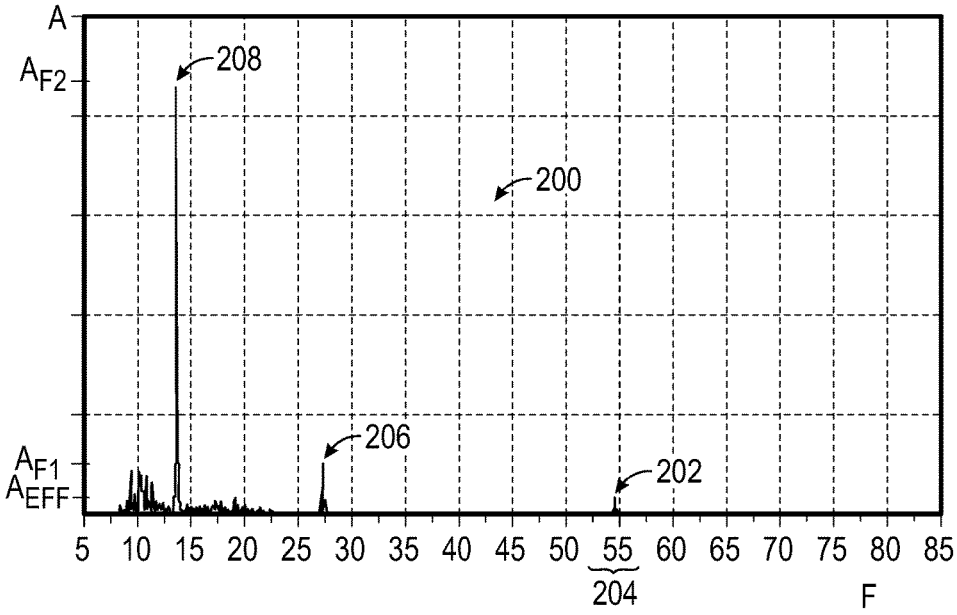
FIG. 3 is an example of a fast Fourier transformed signal for the motor speed sensor of FIG. 1, showing amplitude versus frequency.

In block 104 of FIG. 2, the controller C is programmed to compute a fast Fourier transform (FFT) of the motor speed data (collected in block 102) for the predefined time window. FIG. 3 is an example of a fast Fourier transformed signal 200 for the motor speed sensor 40 of FIG. 1, showing amplitude (A) versus frequency (F). Fourier analysis converts a signal from its original domain, such as time, to a representation in the frequency domain and vice versa. As is understood, fast Fourier transform routines rapidly compute such transforms by computing the discrete Fourier transform (DFT) of a sequence, or its inverse, and factorizing the DFT matrix into a product of sparse factors. The data returned by fast Fourier transforms may be represented in terms of the amplitude (i.e. magnitude) and phase of a given frequency bin.

In block 106, the controller C is programmed to obtain an engine firing frequency (EFF) from the fast Fourier transformed signal 200 as a peak 202 (i.e., relative maximum) within a predefined range 204 of a calculated engine firing frequency ($EFF_c$). In one example, the predefined range may be 4%. For example, if the calculated engine firing frequency ($EFF_c$) is 54 Hz, the controller C may be programmed to look for a relative maximum within 54±2 Hz.

The calculated engine firing frequency ($EFF_c$) may be obtained by the controller C as a product of an average engine speed during the predefined time window and a factor. The factor is the number of cylinders in the engine divided by two ($n_{cyl}/2$). For example, if the average engine speed is 1620 rpm (which is equivalent to 27 Hz) and the number of cylinders is 4, the calculated engine firing frequency ($EFF_c$) is 54 Hz (27*4/2). The average engine speed may be determined from engine speed data obtained by the engine speed sensor 40. Additionally, the controller C may be programmed to determine the average engine speed based on other methods, without employing sensors, such as finite element analysis (FEA) or other methods.

In block 108, the controller C is programmed to obtain a first amplitude ($A_{F1}$) at a first reference frequency (F1) (shown as peak 206 in FIG. 3) from the fast Fourier transformed signal 200. A second amplitude ($A_{F2}$) at a second reference frequency (F2) (shown as peak 208 in FIG. 3) is obtained from the fast Fourier transformed signal 200. A third amplitude ($A_{EFF}$) at the engine firing frequency (EFF) (shown as peak 202 in FIG. 3) is obtained from the fast Fourier transformed signal 200. In block 108, the controller C is programmed to determine if at least one of the first amplitude ($A_{F1}$) and the second amplitude ratio ($A_{F2}$) is at or above the third amplitude ($A_{EFF}$). If either $A_{F1} \geq A_{EFF}$ or $A_{F2} \geq A_{EFF}$, the method 100 proceeds to block 110. Otherwise the method 100 loops back to block 102, as indicated by line 109.

In block 110, the controller C is programmed to obtain a first ratio ($A_{F1}/A_{EFF}$) as a ratio of the first and third amplitudes, and determine if the first amplitude ratio ($A_n/A_{FF}$) is at or above a first threshold ($T_1$). The first reference frequency (F1) may be half the engine firing frequency (EFF) such that (EFF=2*F1).

If the first ratio ($A_n/A_{FF}$) is at or above the first threshold ($T_1$), the method 100 proceeds to block 112, where the controller C is programmed to shift to a first predefined operating mode (indicated as "$O_1$" in FIG. 2) and/or display a first message or reminder (indicated as "$M_1$" in FIG. 2) to a user interface 50, shown in FIG. 1, communicating that the engine 14 needs a check-up. The user interface 50 may be a driver information screen in the instrument panel (not shown), which may include a reminder icon that lights up. The user interface 50 may be a heads-up display reflected off a screen (not shown) of device 12. The first predefined operating mode ($O_1$) is configured to limit the power received by the engine 14. In one example, the first predefined operating mode ($O_1$) is configured to prevent high acceleration of the device 12, as in a "limp home" mode.

Referring to FIG. 2, if the first ratio ($A_n/A_{FF}$) is below the first threshold ($T_1$), the method 100 proceeds from block 110 to block 114. In block 114, the controller C is programmed to obtain a second ratio ($A_{F2}/A_{EFF}$) as a ratio of the second and third amplitudes, and determine if the second ratio ($A_{F2}/A_{FF}$) is at or above a second threshold ($T_2$). The second reference frequency (F2) may be half the first reference frequency (F1) such that (F1=2*F2).

To obtain the first and second thresholds ($T_1$, $T_2$), calibration data may be taken in a test cell or laboratory at various motor speeds at a baseline temperature. The first and second thresholds ($T_1$, $T_2$) may be obtained for a particular engine 14 by employing finite element analysis and the physical properties of the components of the assembly 10.

Referring to FIG. 2, if the second ratio ($A_{F2}/A_{FF}$) is at or above the second threshold ($T_2$), the method 100 proceeds from block 114 to block 116, where the controller C is programmed to shift to a second predefined operating mode ($O_2$) and/or display a second message ($M_2$) on the user interface 50. The second message ($M_2$) may be a "Check Engine Cylinder" flashing message. The second predefined operating mode ($O_2$) may be configured to reduce power to vehicle accessories. The method 100 loops back to block 102 from block 116, as indicated by line 117. The second message ($M_2$) may include a "Check Fuel Injector" or "Check Spark Plug" message.

If the second ratio ($A_{F2}/A_{FF}$) is below the second threshold ($T_2$), the method 100 proceeds from block 114 to block 118, where the controller C is programmed to shift to a third predefined operating mode ($O_3$) and/or display a third message ($M_3$) on the user interface 50. The first predefined operating mode ($O_r$) indicates the greatest level of irregularities in cylinder firing, the second operating mode ($O_2$) indicates an intermediate level while the third operating mode ($O_3$) indicates the lowest level. The method 100 loops back to block 102 from block 118, as indicated by line 119.

The controller C may be an integral portion of, or a separate module operatively connected to, other controllers of the device 12. The controller C includes a computer-readable medium (also referred to as a processor-readable medium), including a non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which may constitute a main memory. Such instructions may be transmitted by one or more transmission media, including coaxial cables, copper wire and fiber optics, including the wires that comprise a system bus coupled to a processor of a computer. Some forms of computer-readable media include, for example, a floppy disk, a flexible disk, hard disk, magnetic tape, other magnetic medium, a CD-ROM, DVD, other optical media, punch cards, paper tape, other physical media with patterns of holes, a RAM, a PROM, an EPROM, a FLASH-EEPROM, other memory chip or cartridge, or other medium from which a computer can read.

Look-up tables, databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store may be included within a computing device employing a computer operating system such as one of those mentioned above, and may be accessed via a network in one or more of a variety of manners. A file system may be accessible from a computer operating system, and may include files stored in various formats. An RDBMS may employ the Structured Query Language (SQL) in addition to a language for creating, storing, editing, and executing stored procedures, such as the PL/SQL language mentioned above.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. A powertrain assembly comprising:

an engine having at least one cylinder;

at least one electric machine operatively connected to the engine;

a motor speed sensor operatively connected to and configured to obtain motor speed data of the at least one electric machine;

a controller operatively connected to the motor speed sensor, the controller including a processor and tangible, non-transitory memory on which is recorded instructions for executing a method for detection of firing irregularities in the at least one cylinder;

wherein execution of the instructions by the processor causes the controller to:

obtain the motor speed data at a predefined time interval from the motor speed sensor, until a predefined time window is reached;

obtain a fast Fourier transform of the motor speed data during the predefined time window;

obtain a calculated engine firing frequency as a product of an average engine speed during the predefined time window and a factor, wherein the factor is a number of the one or more cylinders in the engine divided by two ($n_{cyl}/2$);

obtain an engine firing frequency (EFF) from the fast Fourier transform, the engine firing frequency (EFF) being a relative maximum within a predefined range of the calculated engine firing frequency;

obtain a first amplitude ($A_{F1}$) at a first reference frequency (F1) from the fast Fourier transform, the first reference frequency (F1) being half the engine firing frequency (EFF);

obtain a third amplitude ($A_{EFF}$) at the engine firing frequency (EFF) from the fast Fourier transform;

determine if a first ratio ($A_{F1}/A_{FF}$) of the first amplitude and the third amplitude is at or above a first threshold ($T_1$); and wherein the controller is configured to control the engine based at least partially on a comparison of the first ratio ($A_{F1}/A_{FF}$) and the first threshold ($T_1$).

2. The assembly of claim 1, further comprising:

an engine speed sensor operatively connected to and configured to obtain an engine speed data;

wherein the controller is programmed to:

obtain the engine speed data at the predefined time interval from the engine speed sensor until the predefined time window is reached; and obtain the average engine speed from the engine speed data.

3. The assembly of claim 1, wherein controlling the engine based at least partially on the comparison of the first ratio ($A_{F1}/A_{FF}$) and the first threshold ($T_1$) includes:

shifting to a first predefined operating mode ($O_1$) if the first ratio ($A_{F1}/A_{FF}$) is at or above the first threshold ($T_1$).

4. The assembly of claim 1, wherein the controller is programmed to:

obtain a second amplitude ($A_{F2}$) at a second reference frequency (F2) from the fast Fourier transform, the second reference frequency (F2) being half the first reference frequency (F1), obtain a second ratio ($A_{F2}/A_{EFF}$) as a ratio of the second and third amplitudes; and if the first ratio ($A_{F1}/A_{FF}$) is below the first threshold ($T_1$), determine if the second ratio ($A_{F2}/A_{FF}$) is at or above a second threshold ($T_2$).

5. The assembly of claim 4, further comprising a user interface and wherein the controller is programmed to:

if the second ratio ($A_{F2}/A_{FF}$) is at or above the second threshold ($T_2$), display a first message on the user interface; and if the second ratio ($A_{F2}/A_{FF}$) is below the second threshold ($T_2$), display a second message on the user interface.

6. The assembly of claim 4, wherein the controller is programmed to:

if the second ratio ($A_{F2}/A_{FF}$) is at or above the second threshold ($T_2$), shift to a second predefined operating mode ($O_2$); and if the second ratio ($A_{F2}/A_{FF}$) is below the second threshold ($T_2$), shift to a third predefined operating mode ($O_3$).

7. A method for controlling a powertrain assembly having an engine with at least one cylinder, at least one electric machine, a motor speed sensor operatively connected to and configured to obtain motor speed data of the at least one electric machine, and a controller having a processor and tangible, non-transitory memory, the method comprising:

obtaining the motor speed data at a predefined time interval from the motor speed sensor, until a predefined time window is reached;

obtaining a fast Fourier transform of the motor speed data during the predefined time window, via the controller;

detecting firing irregularities in the at least one cylinder based at least partially on the fast Fourier transform, including:

obtaining a calculated engine firing frequency as a product of an average engine speed during the predefined time window and a factor, wherein the factor is a number of the one or more cylinders in the engine divided by two ($n_{cyl}/2$);

obtaining an engine firing frequency (EFF) from the fast Fourier transform, the engine firing frequency (EFF) being a relative maximum within a predefined range of the calculated engine firing frequency;

obtaining a first amplitude ($A_{F1}$) at a first reference frequency (F1) from the fast Fourier transform, the first reference frequency (F1) being half the engine firing frequency (EFF);

obtaining a third amplitude ($A_{EFF}$) at the engine firing frequency (EFF) from the fast Fourier transform and a first ratio ($A_{F1}/A_{FF}$) of the first amplitude and the third amplitude; and controlling the engine based at least partially on a comparison of the first ratio ($A_{F1}/A_{FF}$) and the first threshold ($T_1$).

8. The method of claim 7, wherein controlling the engine based at least partially on the comparison of the first ratio ($A_{F1}/A_{FF}$) and the first threshold ($T_1$) includes:

shifting to a first predefined operating mode ($O_1$) if the first ratio ($A_{F1}/A_{FF}$) is at or above the first threshold ($T_1$).

9. The method of claim 8, further comprising:

obtaining a second ratio ($A_{F2}/A_{EFF}$) as a ratio of the second and third amplitudes; and if the first ratio ($A_{F1}/A_{FF}$) is below the first threshold ($T_1$), determining if the second ratio ($A_{F2}/A_{FF}$) is at or above a second threshold ($T_2$).

10. The method of claim 9, further comprising:

if the second ratio ($A_{F2}/A_{FF}$) is at or above the second threshold ($T_2$), display a first message on a user interface; and if the second ratio ($A_{F2}/A_{FF}$) is below the second threshold ($T_2$), display a second message on the user interface.

11. The method of claim 10, further comprising:

if the second ratio ($A_{F2}/A_{FF}$) is at or above the second threshold ($T_2$), shifting to a second predefined operating mode ($O_2$); and if the second ratio ($A_{F2}/A_{FF}$) is below the second threshold ($T_2$), shifting to a third predefined operating mode ($O_3$).

12. A vehicle comprising:

an engine having one or more cylinders;

an electric machine operatively connected to the engine;

a motor speed sensor operatively connected to and configured to obtain motor speed data of the electric machine;

a controller operatively connected to the motor speed sensor, the controller including a processor and tangible, non-transitory memory on which is recorded instructions for executing a method for detection of irregularities in firing of the one or more cylinders;

wherein execution of the instructions by the processor causes the controller to:

obtain the motor speed data at a predefined time interval from the motor speed sensor, until a predefined time window is reached;

obtain a fast Fourier transform of the motor speed data during the predefined time window;

obtain a calculated engine firing frequency as a product of an average engine speed during the predefined time window and a factor, wherein the factor is a number of the one or more cylinders in the engine divided by two ($n_{cyl}/2$);

obtain an engine firing frequency (EFF) from the fast Fourier transform, the engine firing frequency (EFF) being a relative maximum within a predefined range of the calculated engine firing frequency;

obtain a first amplitude ($A_{F1}$) at a first reference frequency (F1) from the fast Fourier transform, the first reference frequency (F1) being half the engine firing frequency (EFF);

obtain a second amplitude ($A_{F2}$) at a second reference frequency (F2) from the fast Fourier transform, the second reference frequency (F2) being half the first reference frequency (F1);

obtain a third amplitude ($A_{EFF}$) at the engine firing frequency (EFF) from the fast Fourier transform;

determine if a first ratio ($A_{F1}/A_{FF}$) of the first amplitude and the third amplitude is at or above a first threshold ($T_1$);

determine if a second ratio ($A_{F2}/A_{FF}$) of the second amplitude and the third amplitude is at or above a second threshold ($T_2$); and wherein the controller is configured to control the engine based at least partially on a comparison of the first ratio ($A_{F1}/A_{FF}$) and the second ratio ($A_{F2}/A_{FF}$) to the first threshold ($T_1$) and the second threshold ($T_2$), respectively.

13. The vehicle of claim 12, wherein controlling the engine includes:

shifting to a first predefined operating mode ($O_1$) if the first ratio ($A_{F1}/A_{FF}$) is at or above the first threshold ($T_1$); and shifting to a second predefined operating mode ($O_2$) if the second ratio ($A_{F2}/A_{FF}$) is at or above the second threshold ($T_2$).

* * * * *